US007912387B2

(12) United States Patent
Scheuer et al.

(10) Patent No.: US 7,912,387 B2
(45) Date of Patent: Mar. 22, 2011

(54) SCREEN CONFIGURATION FOR USE IN A TONER CONCENTRATION FIELD MEASUREMENT TOOL

(75) Inventors: Mark A Scheuer, Williamson, NY (US); Mark S Petrush, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 181 days.

(21) Appl. No.: 12/466,406

(22) Filed: May 15, 2009

(65) Prior Publication Data

US 2010/0290794 A1 Nov. 18, 2010

(51) Int. Cl.
*G03G 15/08* (2006.01)

(52) U.S. Cl. ..... 399/30

(58) Field of Classification Search ..... 399/30, 399/27, 58, 62

See application file for complete search history.

(56) References Cited

U.S. PATENT DOCUMENTS

| | | | | |
|---|---|---|---|---|
| 5,166,729 | A | 11/1992 | Rathbun et al. | |
| 6,377,760 | B1 | 4/2002 | Hagiwara | |
| 6,931,219 | B2 | 8/2005 | Viturro et al. | |
| 2007/0051684 | A1 * | 3/2007 | Grebenyuk et al. | 210/681 |
| 2008/0152367 | A1 * | 6/2008 | Wayman | 399/30 |

* cited by examiner

*Primary Examiner* — David P Porta
*Assistant Examiner* — Kiho Kim

(57) ABSTRACT

A kit used in TC measurement in the field includes a sandwich of 3 screens used for filtration of carrier beads from toner particles within a container. An upper 400 mesh screen has die-cut holes around its edges to allow removal of any beads trapped between the upper screen and a middle 500 mesh screen. A bottom screen of coarse 20 mesh material is used for strength to support the other screens. When a vacuum source connected to a bottom portion of the container is turned ON, the carrier beads approach the screens in the center of the container. The recirculating airflow carries the carrier beads away from the upper screen at the edges. Thus, with the upper screen being die-cut with openings around its edges, these openings allow the trapped beads to return to the inner chamber of the container for removal during cleaning.

20 Claims, 3 Drawing Sheets

SCREEN CONFIGURATION FOR USE IN A TONER CONCENTRATION FIELD MEASUREMENT TOOL

Cross-reference is hereby made to commonly assigned and copending U.S. application Ser. No. 12/028,022, filed Feb. 8, 2008, and entitled "Toner Concentration Field Measurement Tool" by Mark Alan Scheuer, et al. The disclosure of the heretofore-mentioned application is incorporated herein by reference in its entirety.

The present disclosure is related to a toner concentration (TC) measurement device and method that measures the concentration of toner used in electrostatic printing machines, and more particularly, to an improved screen to be used in the TC measurement device.

Electrostatographic machines including printers and copiers form a latent image on the surface of photosensitive material which is identical with an original image, brings toner-dispersed developer into contact with the surface of the photosensitive material, and sticks toner particles only onto the latent image with electrostatic force to form a copied image on a copy sheet. In order to maintain the copy quality of the image transferred to the copy sheet, there are several types of toner concentration measuring devices.

One such device is in U.S. Pat. No. 6,377,760 where a toner concentration apparatus is shown that measures TC by providing first and second light guiding devices whose end surfaces project into a duct traversed by developer fluid and a light receiving device for receiving light transmitted from the first light guiding device to the second light guiding device. In U.S. Pat. No. 6,931,219 an apparatus and method is disclosed for determining TC of a sample comprised of toner and carrier that includes exposing the sample to light; the exposing includes emitting light at a predefined wavelength based upon the color of the toner; detecting the light reflected off the sample with an optical sensor and determining the TC of the sample base upon the light reflected off the sample. These techniques are directed to in-machine TC testing and do not answer problems encountered when measuring TC in the field and separate and apart from a machine. The heretofore mentioned references are included herein by reference to the extent necessary to practice the present disclosure.

The measurement of TC in the field by a technical representative is presently done by indirect means, for example, as shown in U.S. Pat. No. 5,166,729, and with limited results since measurement of clear and shades of gray toner are difficult, if not impossible, to sense relative to gray carrier.

Heretofore, TC has been measured in the laboratory by blowing toner off of carrier which, in turn, is kept captive in a metal cage. By measuring the weight of the cage, the cage with developer, and the cage with carrier only, the TC is easily calculated. Putting the laboratory measurement into the field has proven to be very difficult because the laboratory measurement device is too large, cumbersome and expensive to be used by each technical representative in the field. For example, laboratory scales cost over $1000.00 and are not meant for travel. Removing the toner from the carrier is non-trivial, and proper handling of materials in customer sites has been troublesome. Hence, there is still a need for an efficient, low cost method and apparatus that can be used to measure TC in the field.

The TC method and apparatus in copending U.S. application Ser. No. 12/028,022 for direct gravimetric measurement of TC in the field is simple, cost effective and compact and includes a molded conductive plastic developer container with an entry nozzle for air and a series of screens strategically positioned therein to cover an open portion in the bottom thereof. A portable vacuum cleaner is adapted to fit around the bottom portion of the container. The developer container is configured to take advantage of cyclone separator functionality with multiple screen filtration creating a vortex with applied pressures from the vacuum cleaner to assist in separation of the fine toner from the coarser, high density carrier particles. The multiple screens are cleaned periodically by reversing the air flow. A problem has been encountered because presently there is no feature that prevents a small percentage of the carrier bead population from being trapped between screens during screen filtration and resist cleaning when airflow in the device is reversed and thereby ultimately requiring the container to be replaced.

Hence, in answer to the above-mentioned problem and in accordance with the present disclosure, a sandwich of 3 screens is shown for filtration use in the above-mentioned system with a lower 20 mesh screen for strength, a middle 500 mesh screen to contain the beads inside the container and an upper 400 mesh screen to break the momentum of the agitated beads and keep them from damaging the middle screen. The upper screen has die-cut holes around its edges to allow removal of any trapped beads between the upper screen and the middle screen. When the air is turned ON, the beads approach the screens in the center of the container. Recirculating airflow within the container carries the beads away from the upper screen at the edges. Thus, with the upper screen being die-cut with openings around its edges, the openings allow the trapped beads to return to the inner chamber of the container for removal during cleaning.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
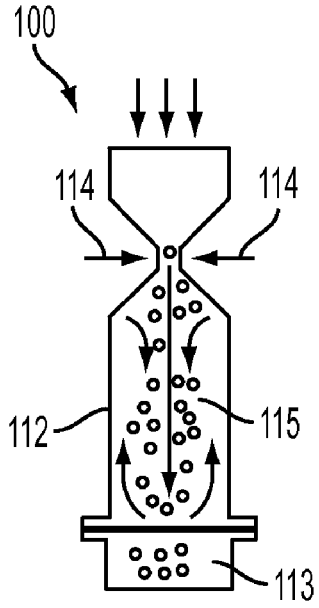
FIG. 1 is a frontal view of an exemplary weighing cage that includes the improved filtration screen design of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method of loading multiple types of paper in a feed tray to allow printing of multiple jobs without operator intervention.

For a general understanding of the features of the disclosure, reference is made to the drawings. In the drawings, like reference numerals have been used throughout to identify identical elements.

Figure 2:
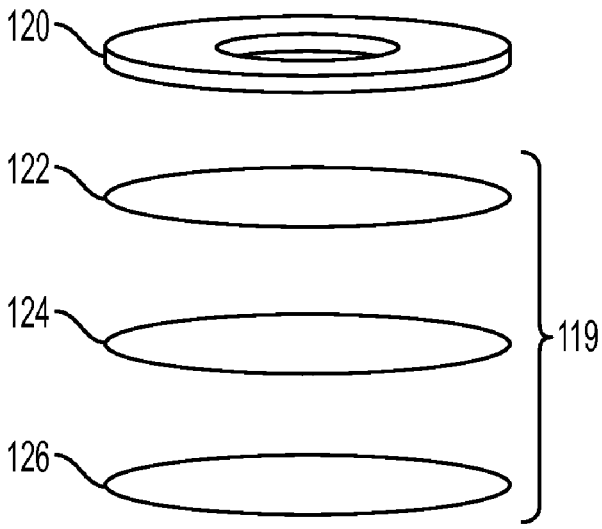
FIG. 2 is an exploded, isometric view of the improved composite filter of the present disclosure and a seal that filter toner from carrier as it is evacuated from the cage of FIG. 1.

Referring now to FIGS. 1-5, parts of a field measurement kit are disclosed for measuring TC in the field. In FIG. 1, cage 112 is a molded conductive plastic unit. The cage has an open upper funnel end that narrows to a throat area of about 5 mm located between arrows 114 that widens out to a straight cylindrical detone chamber. The throat area of the venturi shaped cage is structured to accelerate airflow therethrough which will strip toner off the carrier beads as air is drawn through the open end of the cage. The venturi shape is critical. The streamlined shape keeps the sides free of toner. Any stagnation point in the interior will provide a surface for toner to collect. Carrier beads 115 are airborne during the toner removal stage and will scrape toner that lands on the sides, which can occur when the vacuum is turned ON. The beads form a tornado shape inside the cage and rise to the neck of the venturi as shown by the arrows. The cage has a partially open end at the bottom thereof that is covered by an improved set or sandwich of screens 119 as shown in FIG. 2 in accordance with the present disclosure. The set of metal or fabric screens at the base of the cage contain the carrier beads and allow the toner to pass out of the cage and prevent bead leakage. The sandwiched set of screens consists of a bottom screen of rectangular weave of coarse 20 mesh material (20 openings per inch) 126 for strength to support the other screens, a center 500 mesh screen 124 with 25 micron openings and 0.0009 inch wire to contain the beads inside the cage, and a top 400 mesh screen 122 with 38 micron openings and 0.0011 inch wire to break the momentum of the agitated carrier beads and absorb most of the impact of the carrier beads (and protect the 500 mesh screen from damage). A flat latex gasket seal 120 which could be rubber, if desired, is placed on top of the sandwich of screens to seal the cage. The choice of a 400 mesh coarse screen and a 500 mesh filter screen, while preferred, is dependent on the carrier size distribution and the toner size distribution, it should be understood that larger or smaller particles of both toner and carrier will affect the choice of the screen sizes. Also, while the preference of steel wire screens over nylon, polyester, fabric, etc., is based on the percent of open area, the efficiency of the toner removal and a desire to limit the amount of filter screen area to which the free toner could stick (and effect measurement), any of the aforementioned screens will produce usable results.

Figure 3:
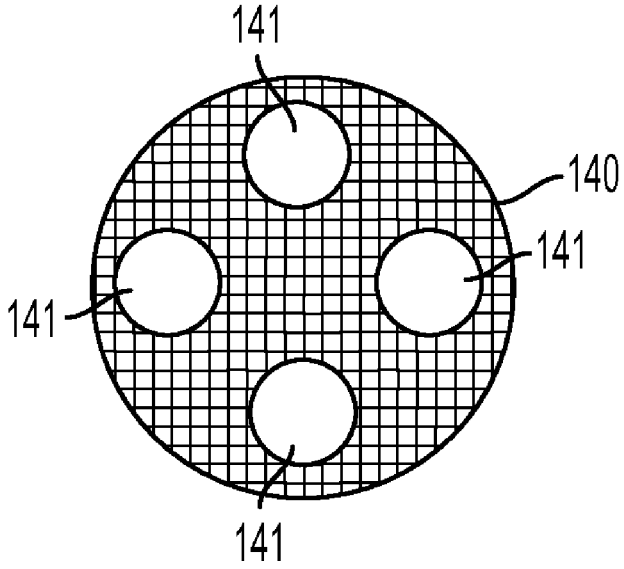
FIG. 3 is a plan view of an improved screen embodiment in accordance with the present disclosure.
Figure 4:
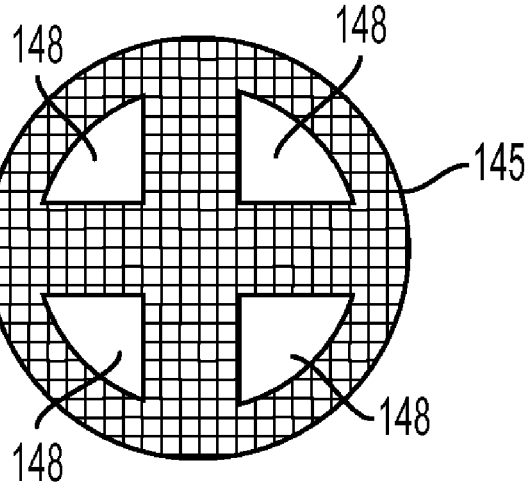
FIG. 4 is a plan view of an alternative improved screen embodiment in accordance with the present disclosure.
Figure 5:
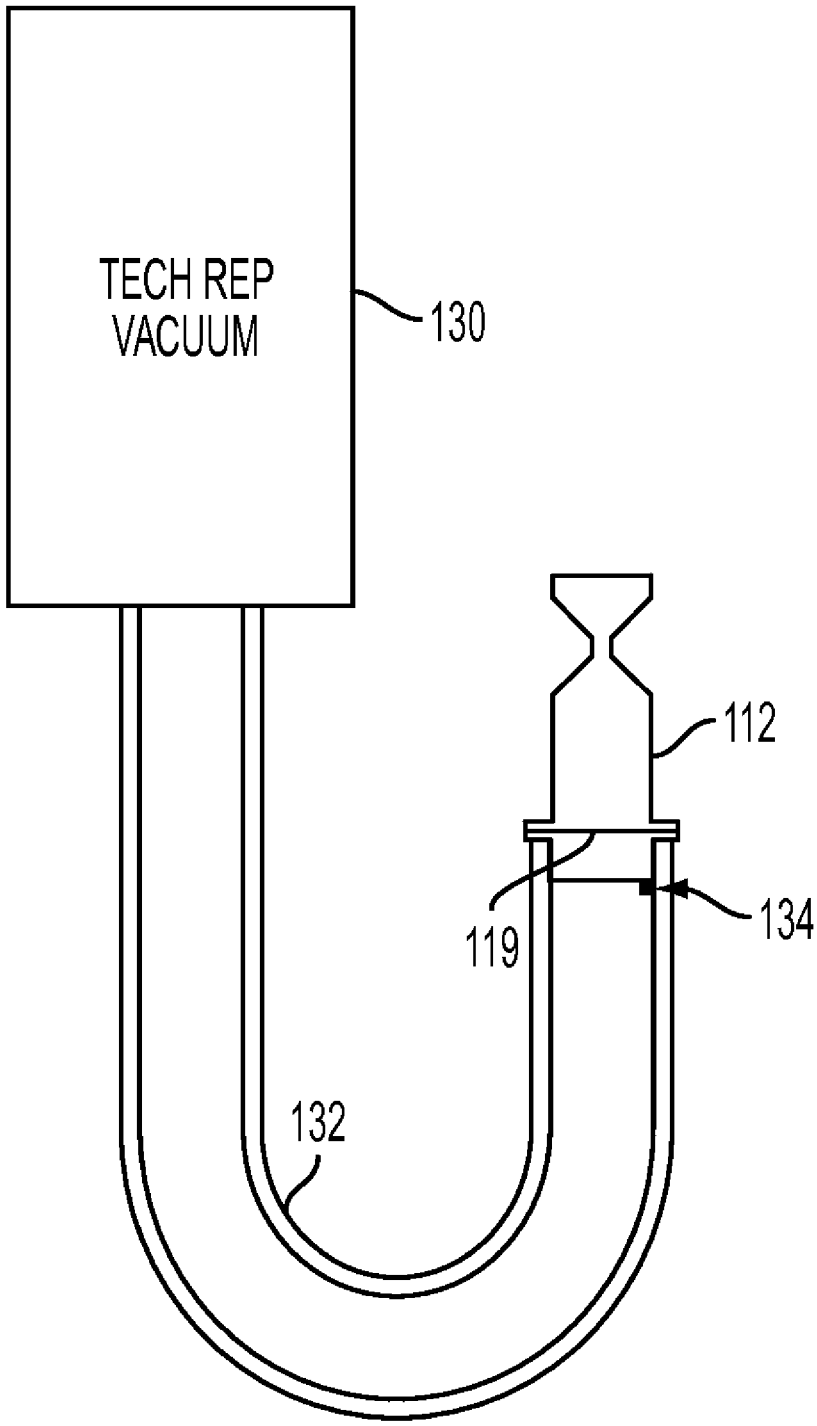
FIG. 5 is a frontal view of the weighing cage of FIG. 1 connected to a vacuum source.

It is possible for a small percentage of the carrier beads to become trapped between the 400 and 500 mesh screens and resist cleaning when air flow is reversed in the system disclosed in FIG. 5 and will eventually require replacement of the screens. These beads become trapped between the 400 and 500 mesh screens, particularly since they have large initial velocity when hitting the 400 mesh screen from above. In some cases, only about 25% of these beads can be removed by back vacuuming cage 112. The trapped beads will eventually clog the screens, cutting off the vacuum air flow, and the cage will cease to function, thus causing a replacement expense. The 400 and 500 mesh screens and a coarse support screen are die-cut from large sheets and spot welded together at their edges. The weld holes are covered with a latex gasket and encapsulated in the plastic housing of the cage so no carrier loss occurs through the weld holes. In order to eliminate the possibility of carrier beads becoming trapped during the cleaning process, and in accordance with the present disclosure, one of die-cut hole patterns 141 and 148 as shown in screens 140 and 145 in FIGS. 3 and 4, respectively, is placed into the 400 mesh screen around its edges to allow any trapped beads to escape while simultaneously providing protection to the 500 mesh screen in the center of the cage. The 400 mesh material must still extend to the edges of the cage to provide mechanical integrity to the screen, which is solely supported on the edges by the welds and the plastic housing. When the air is turned ON, the beads approach the screens in the center of the cage as shown by the arrows and beads in FIG. 1. The recirculating airflow carries the beads away from the screen at the edges. Therefore, sections of the 400 mesh can be removed from the edges without affecting the capacity of the 400 mesh screen to protect the 500 mesh screen. These openings, 141 and 148, allow the trapped beads to return to the inner chamber for removal. Preferred openings or hole patterns 141 and 148 for the 400 mesh screen are shown in FIGS. 3 and 4, but other hole patterns could be employed, if desired. The 400 mesh screen is preferably circular and with or without the openings is die-cut in either case so the added openings do not affect the cost of manufacturing the cage assembly.

In FIG. 5, a portable vacuum source 130 that is part of the heretofore mentioned field measurement kit is shown connected to the bottom end of conductive plastic cage 112 through a hose 132 with the bottom of cage 112 resting on a grounded conductive pin 134 to ensure complete removal of toner.

Over time, as the beads become trapped in the center section of the 400 mesh screen cleaning of the screen necessary, however, simply inverting cage 112 and reversing the air flow is not sufficient to remove the beads caught in the screen. In addition, the user must strike the cage on the side to mechanically move the beads from the closed areas in FIG. 4 to the open areas so the reversed flow can dislodge them from the screen. Now inverting the cage in the vacuum cleaner hose and turning on the vacuum will supply sufficient force to release the beads from the 400 mesh screen and cause them to exit the cage via the throat section of the cage.

In practicing field measuring of TC, a sample of toner/carrier of approximately 3 grams is obtained from a developer housing of a machine and placed into cage 112 which is connected to vacuum source 130 to vacuum the toner off the carrier. The field measurement kit also contains a conventional digital portable scale that has a 1 mg resolution. The digital scale will allow the technical representative to measure the weight of the empty cage, the developer sample in the cage, and the detoned carrier in the cage. Then, using a look-up table, a toner concentration value is determined and used to adjust the calibration of an in-situ toner concentration sensor in software or to validate the current reading from the sensor.

It should now be understood that a method and apparatus that assures a long useful life of a TC measurement device at minimal cost is disclosed that includes a filtration screen that has a die-cut pattern of holes around the periphery thereof that facilitate removal of carrier beads trapped between the filtration screen and a second screen.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A composite filter device adapted to filter carrier beads from toner particles passing through a cage for use in a toner concentration measuring apparatus, comprising;

a top filter screen adapted to allow toner particles to pass therethrough due to an applied vacuum pressure and break the momentum and absorb the impact of agitated carrier beads suctioned thereagainst;

a center filter screen adapted to contain the carrier beads inside said cage; and a bottom filter screen adapted to support said top and center filter screens, and wherein said top filter screen includes a pattern of openings around the periphery thereof that facilitate the cleaning of carrier beads trapped between said top and center filter screens.

2. The composite filter device of claim 1, wherein said top filter screen is a 400 mesh material.

3. The composite filter device of claim 2, wherein said 400 mesh material is 0.0011 inch wire.

4. The composite filter device of claim 3, wherein said wire has openings of about 38 microns.

5. The composite filter device of claim 4, wherein said center filter screen is a 500 mesh material.

6. The composite filter device of claim 5, wherein said 500 mesh material has opening of about 25 microns.

7. The composite filter device of claim 6, wherein said 500 mesh material is 0.0009 inch wire.

8. The composite filter device of claim 7, wherein said bottom filter screen is a rectangular weave of course 20 mesh material.

9. The composite filter device of claim 8, wherein said top, center and bottom screens are welded together.

10. The composite filter device of claim 9, wherein said bottom screen is made of steel.

11. The composite filter device of claim 10, wherein said top filter screen is made of steel.

12. The composite filter device of claim 11, wherein said center filter screen is made of steel.

13. The composite filter device of claim 12, including a seal member positioned on top of said top filter screen.

14. The composite filter device of claim 13, wherein said seal member is made of rubber.

15. The composite filter device of claim 13, wherein said bottom and center filter screens are die cut.

16. The composite filter device of claim 2, wherein said course 20 mesh material has about 20 openings per inch for strength to support said top and center filter screens.

17. The composite filter device of claim 2, wherein said pattern of openings around said periphery of said 400 mesh top filter screen are die-cut and spaced away from a center portion of said 400 mesh top filter screen where the carrier bead motion is toward said 400 mesh top filter screen in order to prevent damage to said center filter screen.

18. The composite filter device of claim 17, wherein 400 mesh top filter screen is circular, and wherein said die-cut pattern of openings around said periphery of said top filter screen are near outer edges of said circular 400 mesh top filter screen to allow trapped carrier beads between said 400 mesh top filter screen said center filter screen to escape but far enough away from said outer edges of said 400 mesh top filter screen to where weld holes made to form said composite filter device do not compromise the mechanical integrity of said welds such that that said 400 mesh top filter screen and said center filter screen do not separate when reverse air flow is employed thereto to clear said carrier beads from said 400 mesh top filter screen and said center filter screen.

19. The composite filter device of claim 1, wherein said pattern of openings around the periphery of said top filter screen are die cut.

20. The composite filter device of claim 19, wherein said openings in said top filter screen are non-circular.

* * * * *